United States Patent [19]

Saito et al.

[11] Patent Number: 4,582,114

[45] Date of Patent: Apr. 15, 1986

[54] CONTINUOUS CASTING APPARATUS FOR THE PRODUCTION OF CAST SHEETS

[75] Inventors: Sadayuki Saito; Noboru Yasukawa; Takao Koshikawa; Tsutomu Nozaki, all of Chiba; Tomoaki Kimura, Hitachi, all of Japan

[73] Assignees: Kawasaki Steel Corporation, Kobe; Hitachi, Ltd., Tokyo, both of Japan

[21] Appl. No.: 603,404

[22] Filed: Apr. 24, 1984

[30] Foreign Application Priority Data

Apr. 28, 1983 [JP] Japan ..... 58-73848

[51] Int. Cl.[4] ..... B22D 11/06

[52] U.S. Cl. ..... 164/432; 164/429; 164/443; 164/481

[58] Field of Search ..... 164/429, 430–432, 164/479, 481

[56] References Cited

U.S. PATENT DOCUMENTS

| | | | |
|---|---|---|---|
| 3,795,269 | 3/1974 | Leconte et al. | 164/432 |
| 4,271,894 | 6/1981 | Kimura et al. | 164/481 |

FOREIGN PATENT DOCUMENTS

| | | | |
|---|---|---|---|
| 2709540 | 9/1978 | Fed. Rep. of Germany . | |
| 2926181 | 1/1980 | Fed. Rep. of Germany . | |
| 1090019 | 3/1955 | France | 164/432 |
| 79730 | 7/1978 | Japan | 164/432 |
| 14124 | 1/1980 | Japan | 164/432 |
| 25261 | 2/1982 | Japan | 164/432 |
| 50263 | 3/1982 | Japan | 164/432 |
| 100853 | 6/1982 | Japan | 164/432 |
| 32551 | 2/1983 | Japan . | |
| 616354 | 3/1980 | Switzerland | 164/432 |

*Primary Examiner*—Francis S. Husar
*Assistant Examiner*—Jerry Kearns
*Attorney, Agent, or Firm*—Balogh, Osann, Kramer, Dvorak, Genova & Traub

[57] ABSTRACT

A continuous casting apparatus for the production of cast sheets having a casting space defined by a pair of opposed endless belts and a pair of side plates arranged near the side edge portions of the belts while being brought into intimate contact therewith and designed to be converged toward a drawing direction. In this apparatus, a filmy water flow-forming pad arranged behind each of the belts, and each of the side plates are so profiled that the casting space inclusive of the tapered portion depicts a smooth curve at at least a transition area from the taper end portion to a constant thickness portion.

6 Claims, 8 Drawing Figures

CONTINUOUS CASTING APPARATUS FOR THE PRODUCTION OF CAST SHEETS

BACKGROUND OF THE INVENTION (1) Field of the Invention:

This invention relates to a continuous casting apparatus, and more particularly to a continuous casting apparatus for the direction production of cast sheets.

(2) Description of the Prior Art:

Heretofore, metal sheets have been manufactured by preparing an ingot through an ingot making method, blooming the ingot to produce a slab of 100–300 mm in thickness, roughly rolling the slab to obtain a sheet bar of about 30 mm in thickness, and then rolling the sheet bar with a hot strip mill to produce a metal sheet of not more than 10 mm in thickness.

On the other hand, there is a technique for directly producing a cast sheet according to the continuous casting method as shown in FIG. 1. In this technique, molten metal is poured into a water-cooled mold 102 through a nozzle 101, and after a solidification shell 103 is produced along the mold wall, it is continuously drawn from the mold by means of guide rolls 104 and so on in the form of thick cast slab and then roughly rolled into a cast sheet. However, this method has the following defects. That is, according to this method, since the thickness of the cast slab is determined by the diameter of the nozzle 101, it is better to make the diameter of the nozzle smaller. To the contrary, the diameter of the nozzle is necessary to be not less than 100 mm in order to prevent the solidification of molten metal inside the nozzle during the pouring and is usually 150–170 mm. Therefore, the thickness of the castable slab is restricted to about 130 mm at minimun. In this sense, it is a common practice in the conventional technique using the continuous casting method that a mold is designed in a substantially hollow rectangular shape restricted by the diameter of the nozzle as shown in FIG. 1 and is difficult to draw a thinner cast sheet.

Further, there have hitherto been proposed a continuous casting machine for the production of a thinner cast sheet as shown in FIG. 2. In this case, a casting space 108 having a sectional shape and a predetermined length, which correspond to the intended cast sheet, is defined by a pair of endlessly movable metal belts 106 oppositely faced with each other at a given interval and a pair of side plates 107 positioned near the side edge portions of these metal belts. Each of the metal belts is guided and supported along a predetermined running path through guide rolls 110–113, or 110'–113' and cooled by spraying a cooling fluid onto the back side of each metal belt from spray nozzles 115 located between the guide rolls and behind the belt. Thus, molten steel is poured into an upper basin of the casting space from a pouring nozzle 101, and after a solidification shell is produced along the metal belt constituting the casting space, the resulting cast sheet is drawn from the casting space through lower guide rolls 116. According to such a conventional continuous casting machine, for instance, in order to directly obtain a cast steel sheet by the continuous casting method, the interval between the metal belts 106 and 106 is gradually reduced downward from the upper basin of the casting space positioning the end of the nozzle to form a tapered end portion at the lower end of the casting space, which corresponds to the desired thickness of the cast sheet, by means of guide rolls 111, 111'.

In general, the steel sheet is continuously cast at a high speed, so that it is necessary to complete the solidification of molten metal until it passes through the guide rolls 111, 111' positioned at the tapered end portion or to arrange a cooling means immediately beneath the guide rolls 111, 111' for the purpose of restraining the bulging of the unsolidified cast sheet.

In the conventional continuous casting apparatus of FIG. 2, a sufficient amount of the cooling fluid is required to be sprayed onto the metal belts 106 between the guide rolls 110, 111 (110', 111') from the spray nozzle 115 in order to completely solidify molten steel until it reaches the lower end of the casting space. For this purpose, it is necessary to spray the cooling fluid at a spray pressure as high as several tens atmospheric pressure. However, if the cooling fluid of such a high pressure is sprayed onto the metal belt 106, the metal belt may be locally deformed, and in the worst case, the metal belt is broken depending upon the belt material. As a result, the surface of the metal belt becomes uneven, which causes a problem of deteriorating surface properties of the cast sheet 103. On the other hand, when the metal belts 106 beneath the guide rolls 111, 111' are cooled with the cooling fluid sprayed from the spray nozzles 115 to prevent the bulging, since there inherently exists some gap at the lower region of each of the rolls due to the structure of the apparatus, the cast sheet is not uniformly cooled at a place facing this gap. Consequently, uneven cooling takes place to adversely affect the surface properties of the cast steel sheet.

For this reason, it has been proposed to define the casting space with a pair of water-cooled casting wheels instead of the guide rolls. However, since the cooling zone contributing to the completion of the solidification of molten metal is not larger than one-fourth the whole circumferential length of the wheel, it is necessary to enlarge the radius of the casting wheel, resulting in the unfavorable enlargement of the continuous casting apparatus. Moreover, since gaps are also formed just beneath the casting wheels, the same defects as previously described naturally occur.

SUMMARY OF THE INVENTION

It is, therefore, an object of the invention to eliminate the abovementioned drawbacks of the prior art, and to provide a continuous casting apparatus for the production of cast sheets which can directly produce cast sheets of, for example, about 10–60 mm in thickness, while allowing the production and growth of a strong solidification shell and the reduction of a drawing load.

According to the invention, there is the provision of a continuous casting apparatus for the production of cast sheets comprising a pair of opposed belts endlessly circulated while maintaining such a gap as to hold molten metal over a predetermined distance, and a pair of side plates each located near the both side edge portions of the belts and brought into intimate contact therewith and having a converged shape in a drawing direction for cast sheet, said belts and side plates defining a casting space inclusive of a tapered portion, characterized in that a filmy water flow-forming pad arranged behind each of the belts and each of the side plates are so profiled that the casting space inclusive of the tapered portion depicts a smooth curve at at least a transition area from the taper end portion of the casting space to a constant thickness portion thereof.

In a preferred embodiment of the invention, the transition area depicts an arc having a predetermined radius of curvature. In another preferred embodiment of the invention, the tapered portion of the casting space up to the constant thickness portion depicts an arc having a predetermined curvature or a curve, whose curvature being kept constant until a specified position and then gradually reduced.

BRIEF DESCRIPTION OF THE INVENTION

The invention will be described with reference to the accompanying drawing, wherein.

DETAILED DESCRIPTION OF THE INVENTION

Figure 1:
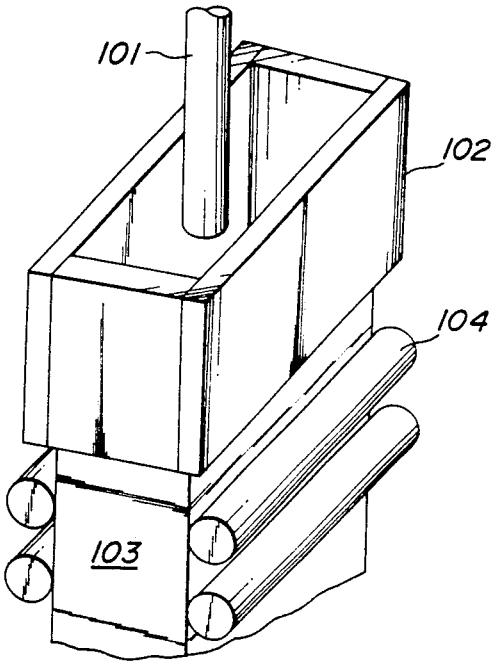
FIG. 1 PRIOR ART
FIGS. 1 and 2 are perspective view illustrating a part of the conventional continuous casting apparatus as mentioned above, respectively.
Figure 2:
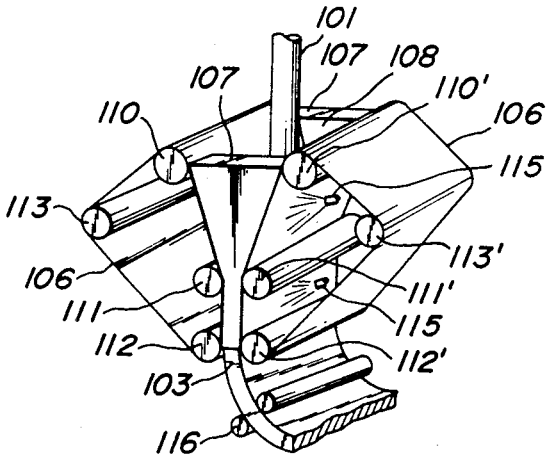
FIG. 2 PRIOR ART
Figure 3:
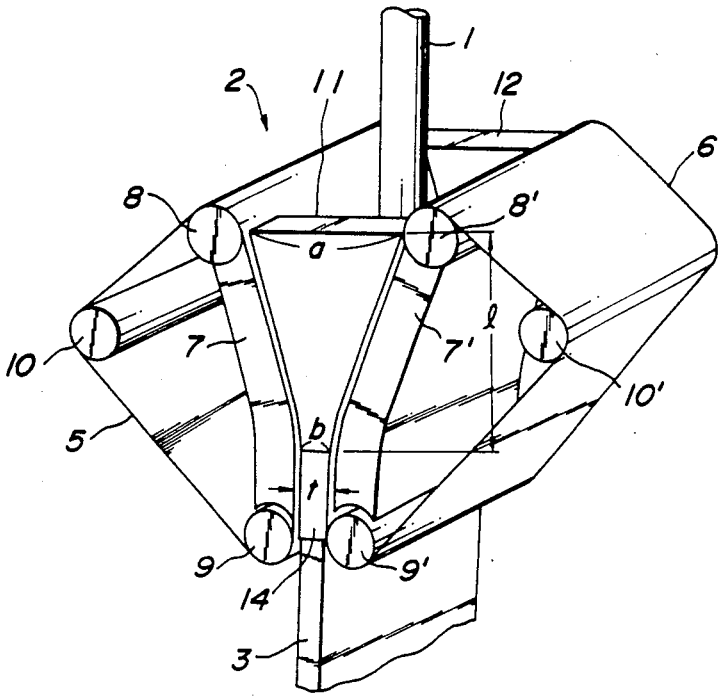
FIG. 3 is a perspective view of an embodiment of the continuous casting apparatus for the production of cast sheets according to the invention.

In FIG. 3, is shown a first embodiment of the continuous casting apparatus for the production of cast sheets according to the invention, wherein a pair of endlessly circulating belts 5, 6 each made, for example, of a metal (hereinafter referred to as metal belt) are arranged oppositely to each other at a predetermined gap (which defines a casting space) under a pouring nozzle 1. That is, each of the metal belts 5, 6 supports a widthwise plane or broad-side plane of a cast sheet. The metal belts 5, 6 are endlessly circulated while maintaining the above gap so as to hold a cast sheet over a predetermined distance by means of a plurality of pairs of support rolls 8, 8', 9, 9', 10, 10' and a pair of filmy water flow-forming pads 7, 7' mentioned later. A casting space 2 defined by the metal belts 5, 6 has a sectional shape similar to that of a funnel (hereinafter referred to as a funneled shape), which is gradually converged from the upper side toward the lower side.

A pair of side plates 11, 12 for supporting narrow-side planes of the cast sheet are located near the both side edge portions of the metal belts 5, 6 and have a tapered shape for defining the casting space 2 of the funneled shape. In this way, the narrow-side of the cast sheet can be forcedly narrowed at a draw ratio of the following relationship being larger than the usual solidification shrinkage amount:

$$(a-b)/l > 2.0\%$$

wherein a, b and l are upper end length, lower end length and taper length of each of the side plates 11 and 12, respectively, whereby a thinner cast sheet can be produced.

It is preferable that the upper end length a of the side plate has a size enough to cover the upper end portion of the funneled shape in the casting space 2 when molten steel is poured into the casting space under non-oxidizing atmosphere through the nozzle 1 immersed in molten steel of the casting space. Needless to say, the side plates 11 and 12 may be arranged to move in the widthwise direction of the cast steel sheet in accordance with the intended width thereof.

Meanwhile, molten steel is cooled upon contact with the metal belts 5, 6 in the casting space 2 to produce thin solidification shell (<10 mm). Upon receiving a static pressure of the poured molten steel, the solidification shells and the metal belts supporting them are subjected to a force in an outwardly spreading direction. In order to control this force, the aforementioned filmy water flow-forming pads 7, 7' are arranged behind the metal belts 5, 6, for support thereof, which pads serve to guide the movement of the metal belts and cool them. The pad 7, 7' is made, for example, of a metal and has such a construction that numerous water injection nozzles *7a* are opened on the metal belt contacting surface of the pad (see FIG. 4), through which the cooling water is jetted to form a filmy water flow for cooling and supporting the metal belt. Moreover, numerous water suction nozzles (not shown) are also disposed in each of the pads for discharging the jetted water while forming the filmy water flow, wherein plural rows of suction nozzles are alternately arranged with plural rows of injection nozzles.

In the illustrated embodiment, if a transition areas from the taper end portion of the casting space 2 to a constant thickness portion thereof constituted with a quenching plate 14 or an area corresponding to a boundary between the taper end portion and the constant thickness portion becomes a bent state, there is a fear that the metal belts 5, 6 are buckled by the influence of such bent portions. For this reason, according to the invention, the side edge portions of each of the side plates 11 and 12 and the corresponding portions of the filmy water flow-forming pads 7, 7' are so profiled that the above area depicts an arc having a predetermined radius of curvature R. In this case, the curvature radius R is 500–5,000 mm, preferably 1,000 to 3,000 mm. If the curvature radius R exceeds 5,000 mm, the passing resistance at the taper end portion becomes smaller, so that the broad-side solidification shell becomes inconveniently thicker unless the casting speed is increased, while the function on the narrow sides must be strengthened in order to control the formation of the narrow-side solidification shell. On the other hand, if the curvature radius R is less than 500 mm, the straightening stress acting on the broad-side solidification shell becomes larger, resulting in the occurrence of drawbacks such as internal crack in the cast sheet and the like. It is preferable that the curvature radius R effective for preventing the belt buckling is about 2,000 mm when the thickness of the belt is 0.5–2 mm.

A cast sheet of 20 mm in thickness and 200 mm in width having good surface properties can be obtained at a casting speed of 15 m/min. without causing troubles such as belt buckling and the like by means of the continuous casting apparatus as shown in FIG. 3, wherein molten steel comprising 0.05% of C, 0.30% of Mn, 0.030% of Al and the remainder being mainly Fe is poured from the pouring nozzle 1 of 170 mm in outer diameter into the casting space 2 (upper end length a: 250 mm, lower end length b≅ constant thickness t: 20 mm, taper lenght l: 700 mm) having a radius of curvature R of 1,000 mm at the taper end portion (or boundary portion transisting from the taper end portion to the constant thickness portion) which is defined by the refractory side plates 11, 12 made of fused silica and the metal belts 5, 6 made of a cold rolled steel sheet of 1.0 mm in thickness and 800 mm in width.

As mentioned above, the first characteristic of the continuous casting apparatus for the production of case sheets according to the invention lies in that when molten steel poured into the casting space contacts with the metal belts and the side plates to produce solidification shells 3 through cooling, the casting is so proceeded that the production rate of the narrow-side solidification shell adjacent to the side plate 11, 12 corresponding to the thickness direction of the cast sheet is made considerably slower than that of the broad-side solidification shell on the metal belt 5, 6, while the narrow-side solidification shell 3 is rapidly grown in the vicinity of the outlet portion of the casting space at a time of obtaining a cast steel sheet with a predetermined thickness.

For instance, in order to prevent the narrowing stress from acting to the metal belts 5, 6 and the pads 7, 7' in the downwardly tapered casting space 2 when molten metal poured from a tundish through the immersion nozzle 1 is cooled by the side plates 11, 12 to form the narrow-side solidification shell, the tapered side plate is so designed that the upper portion of the side plate facing molten metal is lined with a refractory having a small heat conductivity and the lower portion thereof is provided with a water cooling mechanism for promoting the growth of the narrow-side solidification shell, whereby the solidification shell can first be produced on the narrow side of the cast sheet in the constant thickness portion of the casting space. In this way, although molten steel can be completely solidified, the length of the casting space can be relatively made shorter. Moreover, the solidification shell 3 produced inside the casting space 2 (which is defined by the combination of the metal belts and the side plates) are mainly restricted to the broad-side ones, so that the draw ratio of the casting space 2 (the ratio of the difference between upper end and lower end lengths to the taper length of the mold) can be made larger. In other words, the cast sheet of not more than 30 mm in thickness can be directly drawn at the cast sheet-drawing side without being restricted by the diameter of the nozzle 1.

Based on the above mentioned knowledge, in the continuous casting apparatus according to the invention, as shown in FIG. 3, a pair of the side plates 11, 12 each having a downwardly tapered shape, at least the inner wall portion of which being made of a heat insulating material such as a refractory, are arranged and a pair of quenching plates 14 each having a width (t) equal to the thickness of the cast sheet are continuously connected to the lower end of the side plates to form a constant thickness portion of the casting space, at where the narrow side of the cast sheet is rapidly cooled to form a strong shell. Thus, the invention copes with the high speed casting and the reduction of the thickness.

Figure 4:
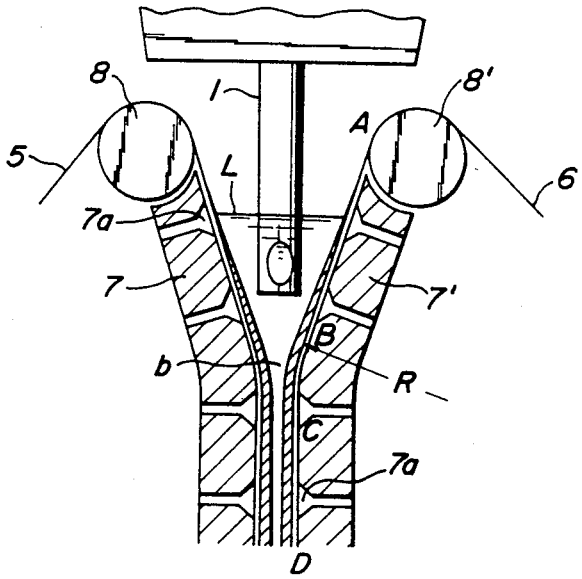
FIG. 4 is a sectional view schematically illustrating the growing state of solidification shell obtained by the continuous casting apparatus of FIG. 3.

As shown in FIGS. 3 and 4, the second characteristic of the continuous casting apparatus according to the invention lies in that each of the side plates 11, 12 and the filmy water flow-forming pads 7, 7' supporting the metal belts 5 and 6 is so profiled that the casting space defined by the combination of the side plates and metal belts depicts a smooth curve being free from the above-mentioned deformation stress at at least an area from the taper end portion of the poured molten steel level to the constant thickness portion thereof.

In the continuous casting apparatus as shown in FIG. 3, when the casting space is converged downwardly, there is still a fear that the solidification shell before the complete solidification of the cast sheet is particularly subjected to the bending stress and the straightening stress at the taper end portion, whereby internal cracks are produced in the cylindrically grown solidification shell to cause breakout. Further, the drawing force including the bending stress and the strightening stress acts upon the pinch rolls as their loads, so that a strong driving force is necessary.

This will be explained with reference to FIG. 4. As to the casting space of the funneled shape defined by a pair of the metal belts 5, 6 supporting the broad side of the cast sheet, a zone A-B is usually straight and a zone B-C is an arc in the area of from molten metal level L to the level of the taper end portion b, while a zone C-D is again straight. For this reason, the produced solidification shell is subjected to the bending stress in the vicinity of a point of transiting from the first straight portion (A-B) to the arc portion (B-C), and to the straightening stress in the vicinity of a point of transiting from the arc portion (B-C) to the straight portion (C-D) corresponding to the constant thickness portion, i.e. the shell is deformed twice. As a result, there is a fear that any adverse affect is imparted upon the quality of the cast sheet, and a large driving force becomes necessary.

Figure 5:
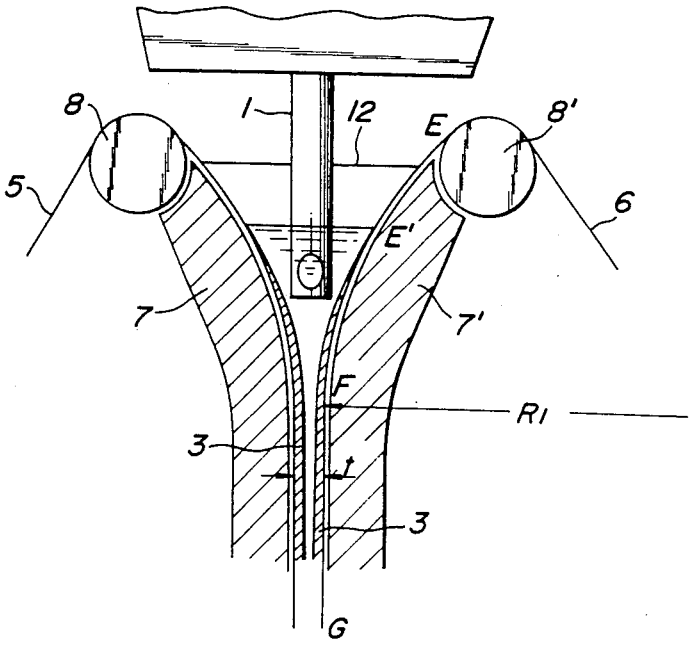
FIG. 5 is a sectional view schematically illustrating the growing state of solidification shell in a second embodiment of the apparatus according to the invention.
Figure 6:
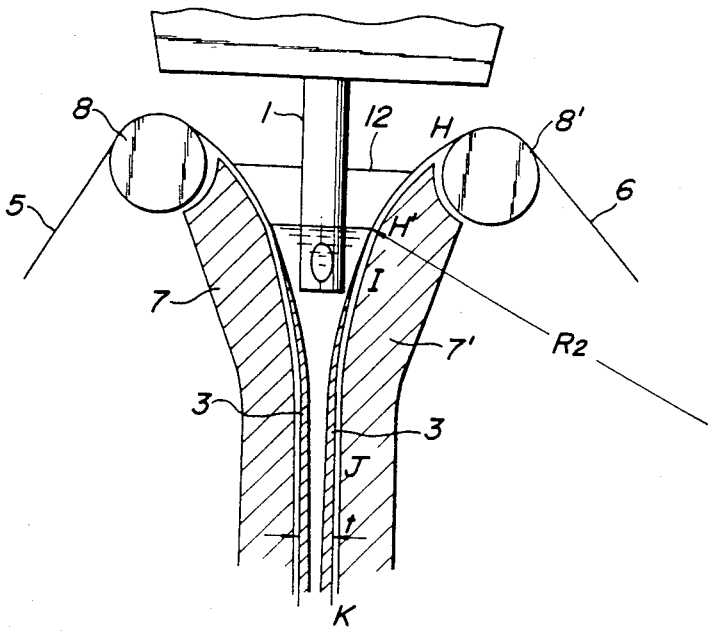
FIG. 6 is a sectional view schematically illustrating the growing state of solidification shell in a third embodiment of the apparatus according to the invention.

According to another preferred embodiment of the invention, the problem that the cast sheet is subjected to the deformation stress two times in the casting space of the funneled shape is further overcome by depicting an area of the casting space from the vicinity of the upper end of the side plate 11, 12 through the taper end portion to the constant thickness portion with an arc having a predetermined radius of curvature $R_1$ (FIG. 5) or by depicting the same area with a curve, whose curvature being kept at a constant curvature radius $R_2$ until a specified position and then gradually reduced (FIG. 6).

In the embodiment of FIG. 5, the broad-side solidification shell 3 corresponding to the metal belt 5, 6 begins to produce from point E', and grows from the point E' through a point F to a point G with the moving of metal belts 5 and 6. Since the zone between E' and F has a constant curvature radius $R_1$, the solidification shell is not subjected to the bending deformation, so that no bending strain acts upon the interior of the solidification shell 3. When the solidification shell 3 reaches the point F to be straightened from the constant curvature radius, the cast sheet is subjected to the straightening deformation to produce the straightening strain therein.

In comparison with the continuous casting apparatus of in FIG. 4, the continuous casting apparatus of FIG. 5 has the following merits:

(a) No bending deformation acts upon the solidification shell;

(b) The straightening deformation (straightening strain, $\epsilon$) can be suppressed to the smaller level since the curvature radius can be made larger.

$$\epsilon_1 = \frac{1}{R}\left(\frac{D}{2} - t\right); \quad \text{(FIG. 4)}$$

$$\epsilon_2 = \frac{1}{R_1}\left(\frac{D}{2} - t\right) \quad \text{(FIG. 5)}$$

$$R < R_1, \epsilon_2 < \epsilon_1$$

In the above, t is a thickness of the solidification shell and D is a thickness of the cast sheet.

In the embodiment of FIG. 6, a zone between H and I of the casting space 2 is an arc (constant curvature radius $R_2$) (in this case, the broad-side solidification shell begins to produce at H'), while the curvature is gradually varied from the arch (curvature radius $R_2$) to a straight line at a zone between I and J. The casting space of such a profile has the following merits:

(1) No bending deformation acts upon the solidification shell (likewise the case of FIG. 5);

(2) The strain due to the straightening deformation is dispersed, so that the degree of the straightening strain becomes lower as compared with that of FIG. 5.

In FIGS. 5 and 6, each of the curvature radii $R_1$ and $R_2$ are 500–5,000 mm, preferably 1,000–3,000 mm as in the embodiment of FIG. 3.

According to the embodiments illustrated in FIGS. 5 and 6, since the grown solidification shell is not subjected to the bending deformation, casting troubles such as breakout and the like are not induced or the quality of the cast sheet is not deteriorated, while the power for drawing the cast sheet is sufficiently small, resulting in economy.

Figure 7:
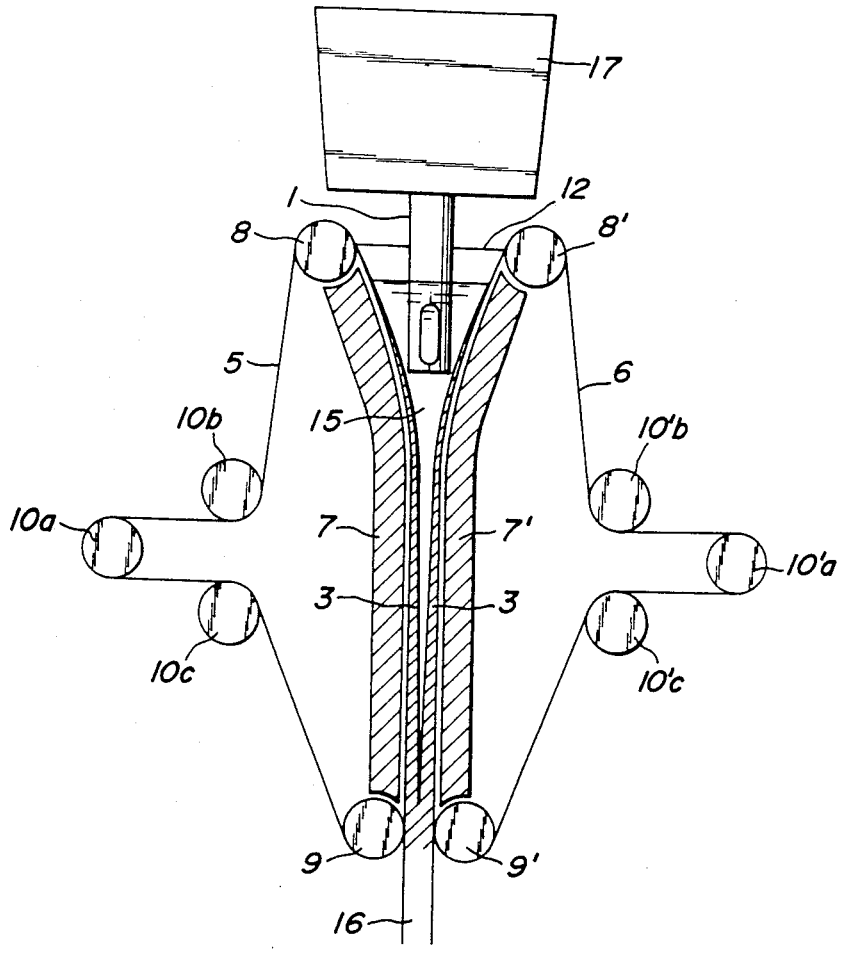
FIG. 7 is a schematic sectional view of a fourth embodiment of the continuous casting apparatus according to the invention in which a cast sheet is drawn downward in a vertical direction.

In FIG. 7, is shown a continuous casting apparatus according to the invention in which a cast steel is drawn downward in a vertical direction, which apparatus being provided with the casting space 2 as shown in FIG. 5. Numerals 5, 6 are a pair of endlessly circulating metal belts oppositely arranged to each other and supported by upper and lower end support rolls 8, 8', 9, 9', and intermediate support rolls 10*a*–10*c*, 10'*a*–10'*c*. The casting space 2 having a rectangular sectional shape corresponding to the section of the intended cast sheet and a length enough to fully solidify molten steel is defined by the opposed metal belts 5, 6 and a pair of side plates 12 (11) for the narrow-side planes of the cast sheet disposed therebetween. Numeral 7, 7' are filmy water flow-forming pads disposed behind the metal 5, 6, and are extended to guide and support the metal belts 5, 6 from the upper end of the casting space 2 of a point of complete solidification of molten steel. As is well-known, a cooling water is jetted and flown between the metal belts 5, 6 and the metal pads 7, 7' through numerous water injection nozzles (not shown) arranged in the pad so as to cool each of the metal belts 5, 6 with a fluid film of the cooling water, whereby molten steel supported between the opposed metal belts is completely solidified until it reaches a lower end support rolls 9, 9'. Numeral 17 is a tundish, numeral 1 is an immersion nozzle through which molten steel is poured into the upper end portion of the casting space 2 from the tundish 17.

According to the aforementioned vertically drawing type continuous casting apparatus, molten steel 15 is poured into the casting space 2 surrounded by the metal belts 5, 6 and the side plates from the tundish 17 through the immersion nozzle 1. The poured molten steel 15 is held within the casting space 2 by means of a dummy bar or other molten steel-supporting member, and then the dummy bar is gradually descended downward, during which molten steel 15 is cooled and solidified mainly with the aid of the metal belts 5, 6 to complete the solidification of molten steel until molten steel reaches the solidification completion point with the movement of the metal belts 5, 6. The thus solidificated cast sheet 16 is vertically drawn from the casting space by means of pinch rolls (not shown) or plural pairs of rolling rolls (not shown) disposed under the lower end support rolls 9, 9'. In the latter case, the distance between the opposed rolls is gradually narrowed up to a distance corresponding to the desired thickness of the steel sheet. If necessary, the steel sheet may be further reduced by rolling to a desired thickness.

In the vertically drawing type continuous casting apparatus, molten steel is completely solified while the solidification shell is held and moved downwardly within the casting space by the metal belts. In this case, the metal belts and the pads have only to possess a strength enough to support the static pressure of molten steel because they do not serve to bend and straighten the unsolidified cast sheet. Further, the static pressure of molten steel is supported by the plane of the metal belt instead of the conventional roll line, which can prevent the occurrence of the bulging in the unsolidified cast sheet.

Figure 8:
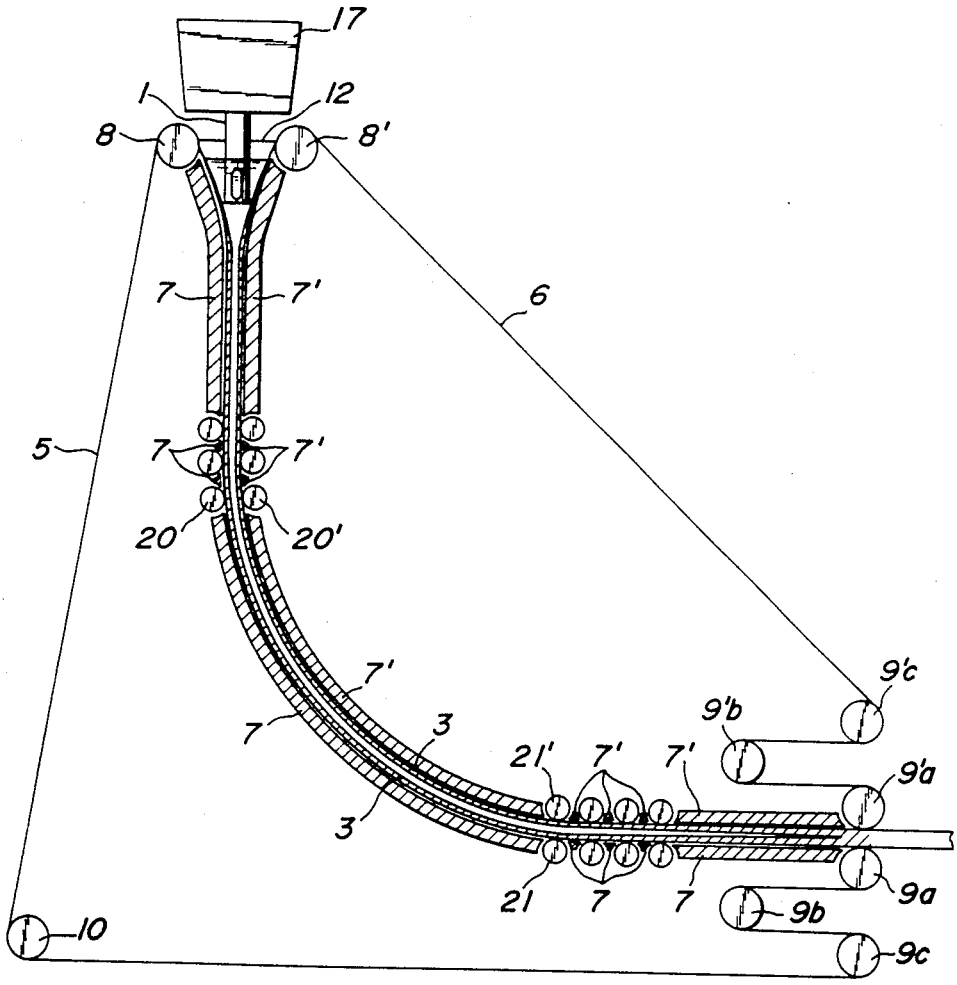
FIG. 8 is a schematic sectional view of a fifth embodiment of the continuous casting apparatus according to the invention in which a cast sheet is drawn in a curved manner.

In FIG. 8 is shown a continuous casting apparatus according to the invention having the casting space 2 as shown in FIG. 6 in which a cast steel sheet is drawn in a curved manner. Numerals 5, 6 are a pair of endlessly circulating metal belts supported by upper and lower end pairs of support rolls 8, 8', 9*a*, 9'*a* and intermediate support rolls 9*b*, 9*c*, 10, 9'*b* and 9'*c* and oppositely arranged to each other. The casting space 2 having a rectangular sectional shape corresponding to the section of the intended cast sheet and a length enough to fully solidify molten steel is defined by the opposed metal belts 5, 6 and a pair of side plate 12 (11) for the narrow-side planes of the case sheet disposed therebetween. Numerals 7, 7' are filmy water flow forming pads arranged behind the metal belts 5, 6, and are extended to guide and support the metal belts 5, 6 from the upper end of the casting space 2 to a point of complete solidification of molten steel. As is well-known, a cooling water is jetted and flown between the metal belts 5, 6 and the pads 7, 7 through numerous water injection nozzles (not shown) arranged in the pad so as to cool the metal belts 5, 6 with a fluid film of the cooling water, whereby molten steel supported between the opposed metal belts is completely solidified until it reaches the lower end support rolls 9*a*, 9'*a*.

According to the aforementioned curvedly drawing type continuous casting apparatus, molten steel is poured into the casting space 2 surrounded by the metal belts 5, 6 and the side plates from the tundish 17 through the immersion nozzle 1. The poured molten steel is held within the casting space 2 by means of a molten steel-supporting member such as dummy bar or the like, and then the supporting member is gradually descended downward, during which molten steel is cooled and solidified mainly with the aid of the metal belts 5, 6, to complete the solidification of molten metal until it reaches the solidification completion point with the movement of the metal belts 5, 6. During this solidification, the solidified cast sheet 16 is forcedly bent by means of plural pairs of guide rolls 20, 20', passed through a pair of curved filmy water flow-forming pads 7, 7', and then straightened in a horizontal direction by means of plural pairs of guide rolls 21, 21', which is horizontally drawn from the curvedly drawing type casting space by means of pinch rolls (not shown) or plural pairs of rolling rolls (not shown) arranged downstream of the lower end support rolls 9*a*, 9'*a*. In the latter case, the distance between the opposed rolls is gradually narrowed up to a distance corresponding to the desired thickness of the steel sheet. If necessary, the steel sheet may be further reduced to a desired thickness. Moreover, the cast sheet is supported by the filmy water flow-forming pads instead of rolls at a place not subjected to a bulging force.

In the above continuous casting apparatus, the casting space can be considerably lengthened though bending and straightening forces are applied to the cast sheet, so that the production of cast sheet can be performed at a higher casting speed. Moreover, when the bending and straightening are carried out by the metal belts and pads, it is necessary to jet a cooling water at a spraying pressure of several tens atmospheric pressure for supporting the metal belt, which results in the deterioration of the surface quality of the cast sheet. In this apparatus, therefore, the bending and straightening of the cast sheet are performed by means of guide rolls, while the metal belts and pads act only for the prevention of bulging.

What is claimed is:

1. A continuous casting apparatus for the production of cast sheets comprising a plurality of pairs of support rolls, a pair of opposed metal belts supported by said pairs of support rolls, said belts endlessly circulating while maintaining a gap such as to hold molten metal over a predetermined distance, a pair of side plates each located near the side edge portions of said belts and having a converged tapered shape in a drawing direction for cast sheet, said belts and side plates defining a casting space inclusive of a tapered portion, a filmy water flow-forming pad supporting each of said pair of opposed belts for guiding and cooling thereof, and water jetting means disposed on the surface of said pad for forming a filmy water flow for cooling said belts, each of the side plates being provided at its upper portion facing the molten metal with a refractory lining and at the remaining portion corresponding to at least a constant thickness portion of the casting space with a water cooling mechanism and being so profiled that the casting space inclusive of the tapered portion depicts a smooth curve in at least a transition area from the taper end portion of the casting space to the constant thickness portion thereof, and said transition area depicts an arc having a radius of curvature of 500 to 5,000 mm.

2. The continuous casting apparatus according to claim 1, wherein the tapered portion of the casting space up to the constant thickness portion depicts an arc having a given curvature.

3. The continuous casting apparatus according to claim 1, wherein the tapered portion of the casting space up to the constant thickness portion depicts a curve, whose curvature being kept constant until a specified position and gradually reduced.

4. The continuous casting apparatus according to claim 1, wherein the radius of curvature is 1,000 to 3,000 mm.

5. The continuous casting apparatus according to claim 1, wherein the unsolidified cast sheet is continuously and vertically guided and supported on and after the constant thickness portion of the casting space by the filmy water flow-forming pads supporting said belts until the solidification of molten metal is completed without being subjected to a bending stress and a straightening stress.

6. The continuous casting apparatus according to claim 1, wherein the unsolidified cast sheet is guided and supported on and after the constant thickness portion of the casting space until the solidification completion point of molten metal by said plurality of pairs of support rolls and filmy water flow-forming pads located between the rolls supporting said belts at that region of the cast sheet which is subjected to a bending stress and a straightening stress and by the belts and pads at the other remaining region not subjected to the bending and straightening stresses.

* * * * *